US006412918B1

(12) United States Patent
Chen et al.

(10) Patent No.: US 6,412,918 B1
(45) Date of Patent: Jul. 2, 2002

(54) BACK-SHOOTING INKJET PRINT HEAD

(75) Inventors: Chia-Tai Chen; Shyh-Haur Su, both of Hsinchu; Ching-Yi Mao, Kaohsiung Hsien; Je-Ping Hu, Taipei Hsien; Charles C. Chang, Hsinchu; Chun-Jung Chen, Yunlin Hsien, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/861,758

(22) Filed: May 21, 2001

(30) Foreign Application Priority Data

Mar. 8, 2001 (TW) ..... 90105378

(51) Int. Cl.[7] ..... B41J 2/05
(52) U.S. Cl. ..... 347/56; 347/65
(58) Field of Search ..... 347/56, 63, 65, 347/44, 47

(56) References Cited

U.S. PATENT DOCUMENTS 5,016,024 A * 5/1991 Lam et al. ..... 347/63
5,305,018 A * 4/1994 Schantz et al. ..... 347/47

* cited by examiner

*Primary Examiner*—John Barlow
*Assistant Examiner*—Juanita Stephens
(74) *Attorney, Agent, or Firm*—J.C. Patents

(57) ABSTRACT

A back-shooting inkjet print head. The inkjet print head comprises: a first substrate having a plurality of thermal resistors formed on a back surface thereof, and a plurality of orifices formed through the first substrate and respectively located proximate to the resistors; an isolation layer having a plurality of ink channels formed therein, wherein the isolation layer is arranged onto the back surface of the first substrate such that the region of each ink channel covers that of one of the resistors and one of the orifices; and a second substrate having an ink supply window, wherein the second substrate is arranged on the isolation layer covering the ink channels, such that the ink supply window, connected to the ink channels, is located at one side of the resistors while the orifices of the first substrate are located at the other side of the resistors and face the second substrate.

15 Claims, 4 Drawing Sheets

BACK-SHOOTING INKJET PRINT HEAD

CROSS-REFERENCE TO RELATED APPLICATION

This application claims the priority benefit of Taiwan application serial no. 90105378, filed on Mar. 8, 2001.

BACKGROUND OF THE INVENTION

1 Field of the Invention

The invention relates to a print head used in a printer. More particularly, the present invention relates to an inkjet print head for a printer.

2 Description of the Related Art

With reference to U.S. Pat. Nos. 4,490,728, 4,809,428, 4,596,994, 4,723,129, 4,774,530, and 4,863,560, a conventional inkjet print head principally comprises: a capillary tube, an orifice plate, and a resistor. The resistor rapidly heats under a voltage pulse, which has a pulse width of a number of micro-seconds. The heating of the resistor is properly controlled such that the temperature of the ink is taken to a vapor nucleation point. The vapor bubble generated, under proper control, then causes ejection of a droplet of ink. With the conventional thermal inkjet technology as described above, a frequency of several kHz can be attained. Traditionally, conventional inkjet print heads typically comprise two types as described hereafter.

Referring to FIG. 1, a construction diagram schematically shows a conventional side-shooting inkjet print head. The conventional side-shooting inkjet print head comprises a thermal barrier layer 22, a thermal resistor layer 24, a conductive layer 26, and an insulating layer 28, sequentially formed on a substrate 10. Through an adequate patterning processes, a plurality of resistors 20 are formed on the substrate 10. A plurality of ink channels 32, respectively comprising the resistors 20 therein, are formed in an isolation layer arranged above the insulating layer 28, the ink channels being covered by a nozzle plate 40. When a resistor 24 rapidly heats, a vapor bubble 50 is generated. The rapid expansion of the vapor bubble 50 causes ejection of a droplet of ink 52. As shown in FIG. 1, the droplet of ink is ejected from the side of the inkjet print head, along the ink channel.

Referring to FIG. 2, a construction diagram schematically shows an up-shooting inkjet print head. The up-shooting inkjet print head of FIG. 2 differs from that described above in FIG. 1 in that the up-shooting inkjet print head has a plurality of orifices 42 in the nozzle plate 40 that respectively face the resistors 20. When a resistor 20 heats the ink in the ink channel 32, the vapor bubble 50 that is generated causes the ejection of the droplet of ink 52 from the orifice 42 facing the resistor 20.

Both foregoing conventional inkjet print head structures are fabricated according to conventional methods as follows. The thermal barrier layer 22 is usually a silicon dioxide ($SiO_2$) layer formed on the substrate 10, which is usually a silicon (Si) substrate, through various method known in the art. Then, the thermal resistor layer 24 and the conductive layer 26 are deposited by typical sputtering. The resistors 20 are formed by photolithography and etching processes applied to the thermal resistor layer 24 and conductive layer 26. The insulating layer 28 is then formed on the resistors 20 to prevent any electrochemical reaction between the resistors and the ink. The ink channels 32 are conventionally formed by specific laser drilling, sand blasting, or ultrasonic milling of a dry film arranged on substrate 10. Finally, the inkjet print head structure is completed by aligning and bonding the nozzle plate 40 over the substrate 10, covering the ink channels 32.

The conventional inkjet print head, such as the above-described, has at least the following drawbacks. Specific machining processes and aligning-bonding are necessary to fabricate the nozzle plate, which substantially increases the fabrication cost, and does not allow for an all-batch process. Besides, the ink channel is formed through using machining processes that can generate residual material and deteriorates the efficiency of the inkjet print head.

An inkjet print head structure that, at least, can overcome the above drawbacks is thus needed.

SUMMARY OF THE INVENTION

A major aspect of the present invention is to provide a back-shooting inkjet print head that can allow for an all-batch process and a low cost of materials.

To attain the foregoing and other objects, the back-shooting inkjet print head, according to an embodiment of the present invention, comprises: a first substrate having a plurality of thermal resistors formed on a back surface thereof, and a plurality of orifices formed through the first substrate and respectively located proximate to the resistors; an isolation layer having a plurality of ink channels formed therein, wherein the isolation layer is arranged onto the back surface of the first substrate such that the region of each ink channel covers the region of one of the resistors and one of the orifices therein; and a second substrate having an ink supply window formed therethrough, wherein the second substrate is arranged on the isolation layer covering the ink channels, such that the ink supply window, connected to the ink channels, is located at one side of the resistors while the orifices of the first substrate are located at the other side of the resistors facing the second substrate.

To attain the foregoing and other objects, the back-shooting inkjet print head, according to another embodiment of the present invention, comprises: a first substrate having a plurality of thermal resistors formed on a back surface thereof, and a plurality of orifices formed through the first substrate and respectively located proximate to the resistors; and a second substrate having a plurality of ink channels formed on a front surface thereof and an ink supply window, connected to the ink channels, formed on a back surface thereof, wherein the second substrate, by its front surface, is arranged on the back surface of the first substrate, thereby covering the ink channels, such that the ink supply window is located at one side of the resistors while the orifices of the first substrate are located at the other side of the resistors facing the ink channels of the second substrate.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
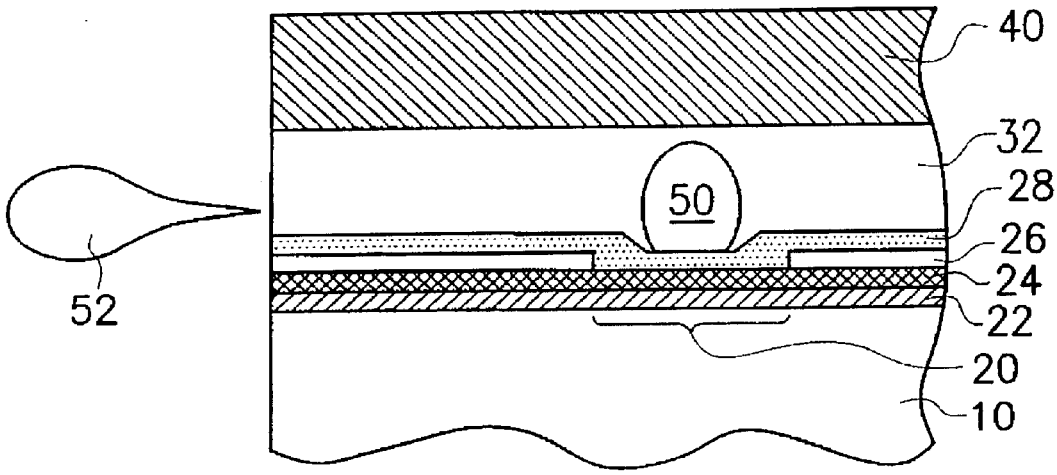
FIG. 1 (PRIOR ART)
FIG. 1 and FIG. 2 are cross-sectional views schematically illustrating conventional inkjet print heads.
Figure 2:
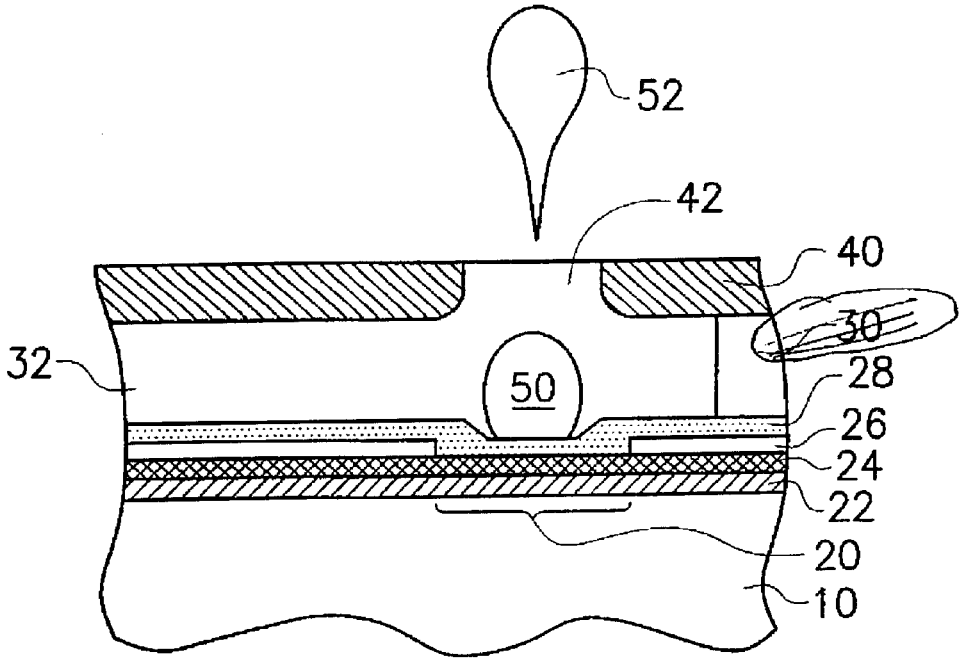
FIG. 2 (PRIOR ART)

The following detailed description of the embodiments and examples of the present invention with reference to the accompanying drawings are only illustrative and not limiting. Wherever possible, like reference numerals are used to refer to like elements.

Figure 3:
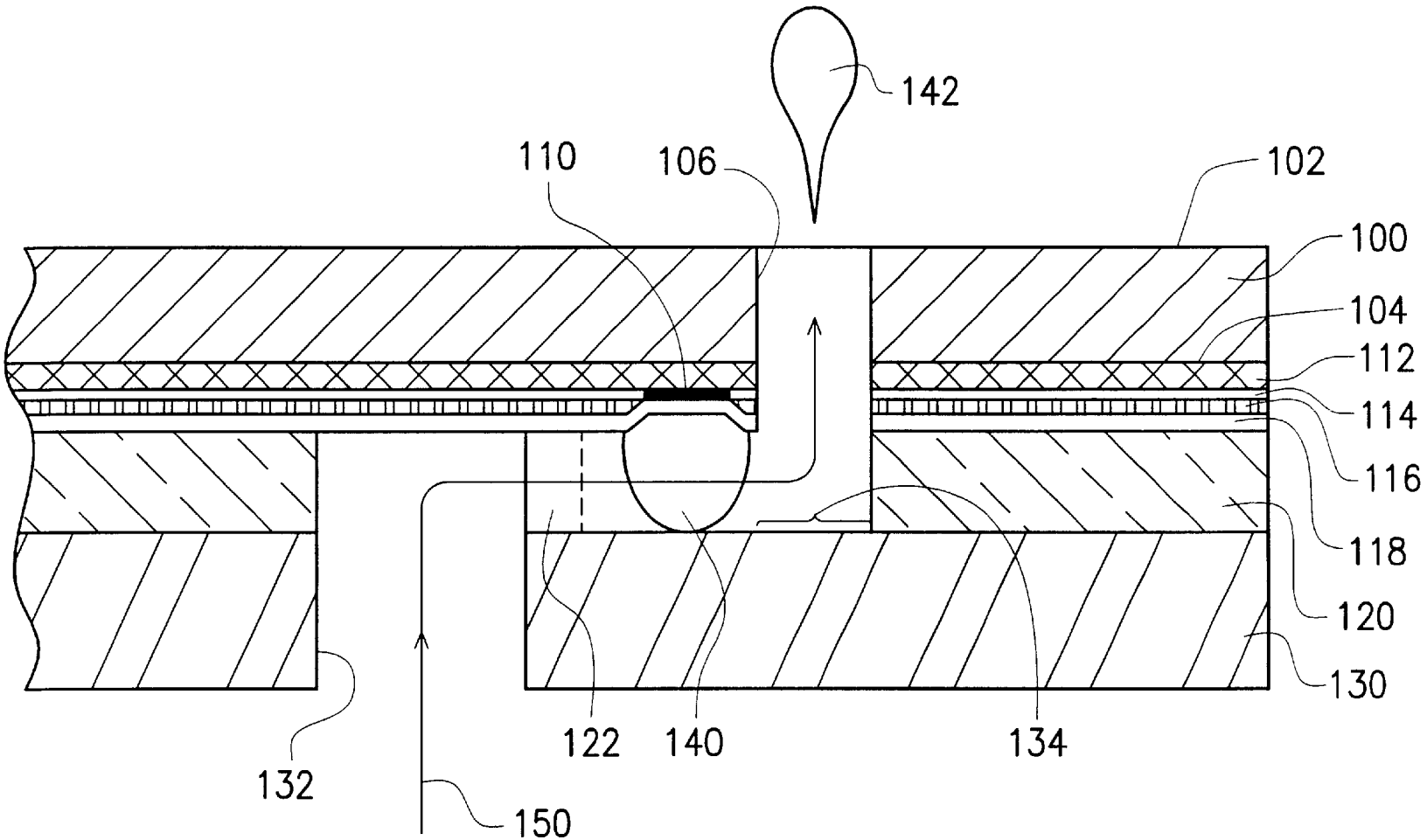
FIG. 3 is a cross-sectional view schematically illustrating a back-shooting inkjet print head, according to an embodiment of the present invention.

Referring now to FIG. 3, a cross-sectional view schematically shows a back-shooting inkjet print head, according to an embodiment of the present invention. A first substrate 100, having a front surface 102 and a back surface 104, is provided with a thermal barrier layer 112, a thermal resistor layer 114, and a conductive layer 116. The first substrate 100 can be, for example, made of silicon, glass, metal, or polymer. Resistors 110 with trace conductors are formed from the thermal resistor layer 114 by conventional semiconductor patterning processes such as photolithography and etching processes. An insulating layer 118 is formed on the conductive layer 116 and the resistors 110. A plurality of orifices 106 are formed through the first substrate 100 and respectively proximate to the resistors 110. An isolation layer 120 is formed on the insulating layer 118, by, for example, pressing a dry film onto the insulating layer 118 with an adhesive there between. In another example, the isolation layer 120 can also be a polymer with a good adhesion property to obtain a substantial bonding of the isolation layer 120 onto the insulating layer 118. A plurality of openings in the isolation layer 120 respectively define a plurality of ink channels 122. The ink channels 122 are positioned such that the region of each ink channel covers therein the region of one of the resistors 110, one of the orifices 106 and the region between the resistors 110 and the orifices 106. The ink channels 122 are formed in the isolation layer 120 through conventional patterning processes. A second substrate 130 is arranged on the isolation layer 120 through, for example, pressing a silicon substrate, glass substrate, or metal substrate coated with an adhesive layer (not shown) onto the isolation layer. The second substrate 130 can also be made of polymer with a good adhesion property to improve the bonding onto the isolation layer 120. The second substrate can be, for example, directly formed on the isolation layer 120 by photolithography and etching processes, thereby avoiding alignment and bonding processes. An opening is formed through the second substrate 130 thereby defining an ink supply window 132. The second substrate 130 is arranged on the isolation layer 120 such that the ink supply window 132 is connected to the ink channels 122. Hence, a passageway for the ink is provided through the ink supply window 132, ink channels 122 to the orifices 106, wherein the ink supply window 132 is located at one side of the resistors 110 while the orifices 106 are located at the other side of the resistors 110 and face a back sidewall portion 134 of the second substrate 130. A back shooting fashion inkjet print head is consequently obtained because the droplet of ink 142 is ejected behind the resistors.

In another example of the present invention, the second substrate 130 can also be a membrane of silicon, glass, metal, or polymer material. The bonding of the membrane does not necessitate substantial accuracy. The bonding of the membrane only requires disposing the second substrate 130 such that the ink supply window 132 is located at one side of the resistors 10 while the orifices 106 are located at the other side of the resistors 110 facing the second substrate 130.

In another embodiment of the present invention, the ink channels 122 and ink supply window 132 can also be formed in the same second substrate 130 that is directly arranged on the back surface 104 of the first substrate 100, without forming the insulating layer 120. The ink channels 122 and ink supply window 132 can be formed, for example, through conventional patterning processes performed on both opposite surfaces of the second substrate 130.

The operation of the back-shooting inkjet print head, such as the above described, is as follows. The ink flows according to the direction 150 through the window 132 into the ink channels 122. Because the section area of the ink channels 122 is substantially small, the ink thus rests therein by capillarity. When a resistor 110 rapidly joule heats, a vapor bubble 140 is generated above the resistor 110 within the ink channel 122. The rapid expansion of the vapor bubble 140 then propels the droplet of ink 142 along the sidewall 134, and through the orifice 106 onto a sheet of paper, according to a back-shooting fashion.

Figure 4:
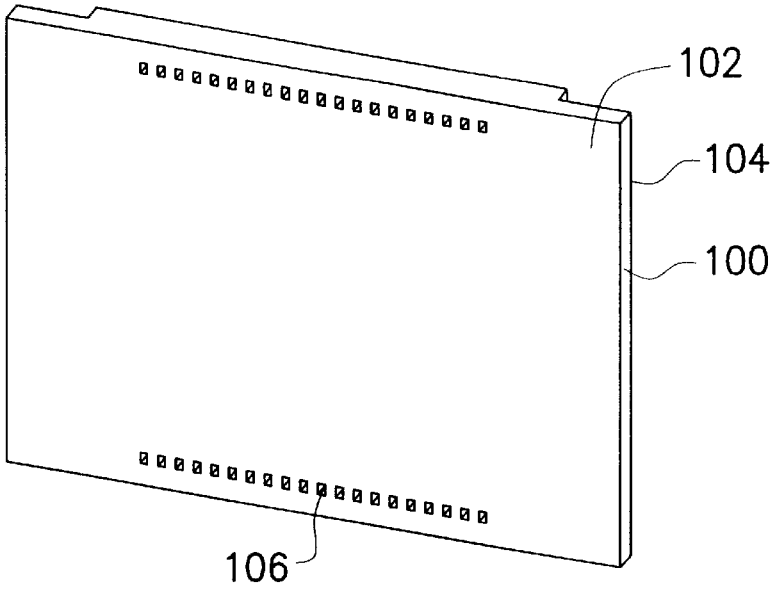
FIG. 4 through FIG. 7 are outer views schematically illustrating the back-shooting inkjet print head, according to an embodiment of the present invention.
Figure 5:
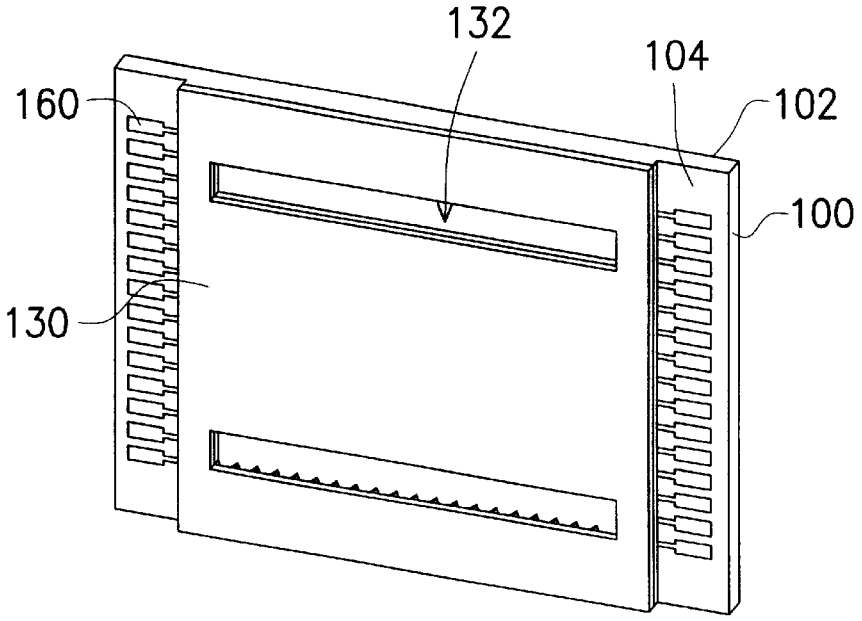

Referring now to FIG. 4 and FIG. 5, an outer front view and outer back view of the back-shooting print head are schematically shown, according to an embodiment of the present invention. The front surface 102 of the first substrate 100 is provided with two rows of orifices 106 respectively along two sides thereof, thereby providing the inkjet outputs. The windows 132, with rectangular shape, are arranged on the second substrate 130 into two rows that correspond to the rows of orifices of the first substrate 100, the windows 132 being the print head inputs. A plurality of metallic pads 160 are arranged along two sides of the back surface 104 of the substrate 100. The metallic pads 160 are electrically connected to the resistors 110, thereby providing the resistors with necessary current for joule heating and generating vapor bubbles.

Figure 6:
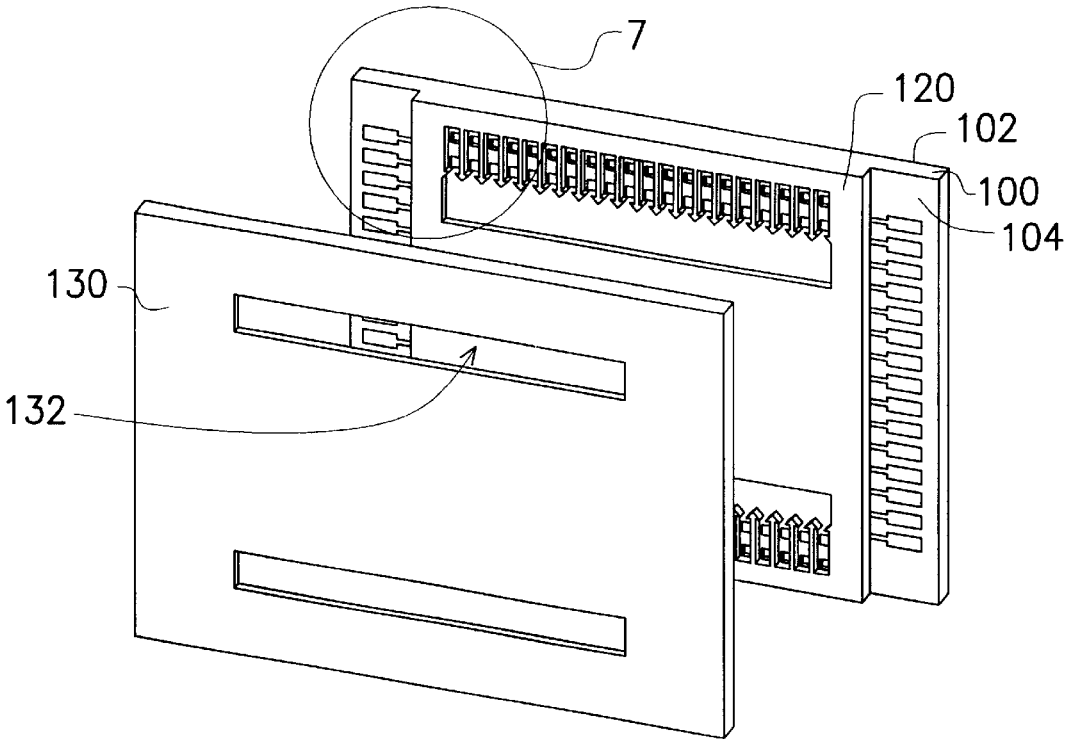
Figure 7:
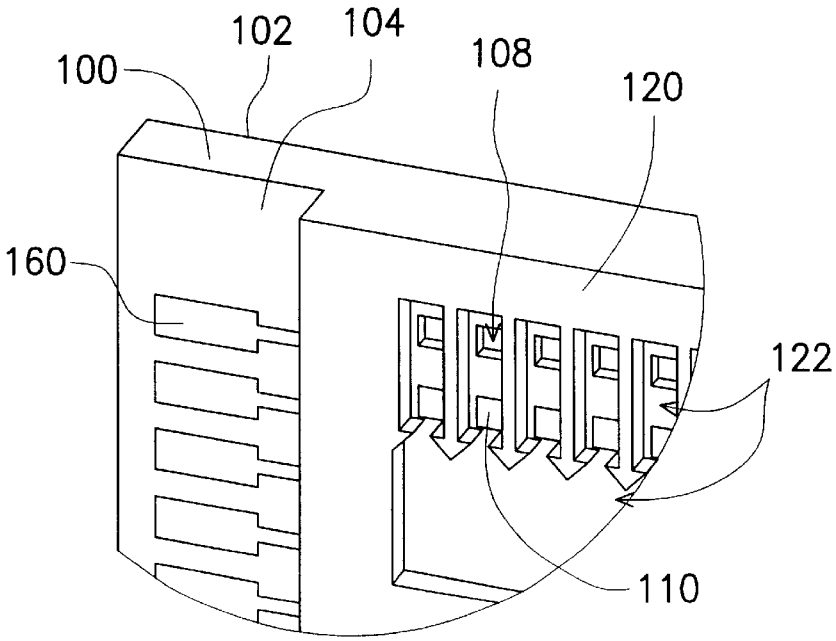

Referring now to FIG. 6 and FIG. 7, FIG. 6 shows a cast view of the back-shooting inkjet print head of FIG. 5 in which the second substrate is dismantled from the first substrate, and FIG. 7 shows an enlarged view of a corner portion of the first substrate. The resistors 110, such as those described above, are arranged on the back surface 104 of the first substrate 100, thereby providing joule heating means for generating vapor bubbles. The orifices 106 that are formed through the first substrate 100 are not immediately adjacent to the resistors 110, and a distance interval can be set between each of the resistors with the corresponding orifice. To provide the necessary current for forming the vapor bubbles, the metallic pads 160 are connected to the resistors 110 through the trace conductors patterned on the conductive layer 116.

The back-shooting inkjet print head, described in the foregoing embodiments and examples of the present invention, provides at least the following advantages.

Since no nozzle plates are used, the orifices of ink ejection are directly formed through the first substrate, and the size of the ink channels and orifices and the cost of materials can thus be reduced. As a result, a conventional technical limitation related to the nozzle plate, due to a limited resolution of an electroforming process applied to the conventional nozzle plate, can be overcome, while the manufacturing cost is reduced. Moreover, the ink channels in the present invention are simply fabricated by photolithography and etching processes, which eliminates the conventional issues related to machining processes. Hence, a substantial advantage of the present invention is the manufacturing of the back-shooting inkjet print head using an all-batch process.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A back-shooting inkjet print head comprising:

a first substrate that has a front surface and a back surface, wherein the back surface comprises a thermal barrier layer, a plurality of resistors within a thermal resistor layer and a conductive layer formed thereon, while a plurality of orifices are formed through the first substrate, the thermal barrier layer, the thermal resistor layer and the conductive layer, respectively proximate to each of the resistors;

an isolation layer that has a plurality of ink channels formed therethrough, wherein the isolation layer is arranged on the back surface of the first substrate such that the region of each ink channel covers the region of one of the resistors and one of the orifices therein; and a second substrate that has an ink supply window formed therethrough, wherein the second substrate is arranged on the isolation layer such that the ink supply window, communicating with the ink channels, is located at one side of the resistors, while the orifices of the first substrate are located at the other side of the resistors facing the second substrate.

2. The back-shooting inkjet print head of claim 1, wherein the material of the first substrate includes silicon, glass, metal or polymer.

3. The back-shooting inkjet print head of claim 1, wherein the resistors comprise a thermal barrier member, a heating member, a conductive member and an insulating member that are sequentially formed on the back surface of the first substrate.

4. The back-shooting inkjet print head of claim 1, wherein the material of the isolation layer includes silicon, glass, metal, or polymer.

5. The back-shooting inkjet print head of claim 1, wherein the material of the isolation layer is a polymer with good adhesion characteristics.

6. The back-shooting inkjet print head of claim 1, wherein the material of the second substrate includes silicon, glass, metal or polymer.

7. The back-shooting inkjet print head of claim 1, wherein the material of the second substrate is a polymer with good adhesion characteristics.

8. The back-shooting inkjet print head of claim 1, wherein an adhesive layer is used to bond the first substrate with the isolation layer.

9. The back-shooting inkjet print head of claim 1, wherein an adhesive layer is used to bond the isolation layer with the second substrate.

10. A back-shooting inkjet print head comprising:

a first substrate that has a front surface and a back surface, wherein the back surface comprises a thermal barrier layer, a plurality of resistors within a thermal resistor layer and a conductive layer formed thereon, while a plurality of orifices are formed through the first substrate, the thermal barrier layer, the thermal resistor layer and the conductive layer, respectively proximate to each of the resistors; and a second substrate that has a plurality of ink channels formed in a front surface thereof and an ink supply window formed on a back surface thereof connected to the ink channels, wherein the back surface of the second substrate is disposed on the back surface of the first substrate with the region of each ink channel covering the region of the resistors and orifices therein, such that the ink supply window is located at one side of the resistors while the orifices of the first substrate, connected to the ink channels, are located at the other side of the resistors facing the second substrate.

11. The back-shooting inkjet print head of claim 10, wherein the material of the first substrate includes silicon, glass, metal or polymer.

12. The back-shooting inkjet print head of claim 10, wherein the resistors comprise a thermal barrier member, a heating member, a conductive member and an insulating member that are sequentially formed on the back surface of the first substrate.

13. The back-shooting inkjet print head of claim 10, wherein the material of the second substrate includes silicon, glass, metal or polymer.

14. The back-shooting inkjet print head of claim 10, wherein the material of the second substrate is a polymer with good adhesion characteristics.

15. The back-shooting inkjet print head of claim 10, wherein an adhesive layer is used to bond the first substrate to the second substrate.

* * * * *